United States Patent [19]

Sweeney

[11] 4,298,075

[45] Nov. 3, 1981

[54] DRIVE MEANS FOR TRAFFIC DELINEATOR

[75] Inventor: Lawrence J. Sweeney, Seneca, Pa.

[73] Assignee: Franklin Steel Company, Franklin, Pa.

[21] Appl. No.: 101,440

[22] Filed: Dec. 10, 1979

[51] Int. Cl.[3] ..... B23B 45/16

[52] U.S. Cl. ..... 173/129; 405/232; 404/133; 173/134

[58] Field of Search ..... 404/10, 133; 173/97, 173/134, 129; 256/1, 13.1; 405/232, 274

[56] References Cited

U.S. PATENT DOCUMENTS

| | | | |
|---|---|---|---|
| 1,875,687 | 9/1932 | Willwerschied | 173/130 |
| 2,844,006 | 7/1958 | Lutz | 404/133 X |
| 2,975,761 | 3/1961 | Fairchild | 404/133 X |
| 3,019,608 | 2/1962 | Marmion | 405/232 |
| 3,034,588 | 5/1962 | Matheny | 173/129 |
| 3,100,382 | 8/1963 | Muller | 405/232 |
| 3,454,113 | 7/1969 | Holtz | 173/97 |
| 3,499,497 | 3/1970 | Moore | 173/129 |

FOREIGN PATENT DOCUMENTS

| | | | |
|---|---|---|---|
| 686909 | 2/1953 | United Kingdom | 173/129 |

*Primary Examiner*—Nile C. Byers, Jr.

*Attorney, Agent, or Firm*—Fitch, Even, Tabin, Flannery & Welsh

[57] ABSTRACT

A drive means is provided for driving into a roadway surface a traffic delineator assembly of the type which includes a channel shaped anchor post having a pair of outwardly extending flanges, the upper end of the channel being connected to a solid pilot plate.

A lower surface of the drive means is positionable on the top of the anchor post and a pair of legs depend from the lower surface to straddle the channel and locate between the flanges of the anchor post and the pilot plate.

An upper surface is provided as a striking surface for driving by manual means e.g., a sledgehammer. An adaptor is provided to link the upper end of the drive means with an impact type drive tool.

9 Claims, 8 Drawing Figures

DRIVE MEANS FOR TRAFFIC DELINEATOR

The present invention relates to post driving means and more particularly a drive means for driving a traffic delineator assembly into a road surface.

In order to improve traffic safety, traffic delineators are being increasingly used to mark the sides of the road. Traffic delineators which protrude above the surface of the road provide better visibility than painted lines and produce a sound when struck by a moving vehicle which alerts a driver that he is edging off the road. Because of the large number of traffic delineators which may be spaced on a multi-lane highway, it is highly desirable that the cost of traffic delineators be kept to a minimum. Among the costs of providing a traffic delineator is the labor cost of installation. It may be necessary to install traffic delineators along an existing highway which means that traffic delineators will be installed in pre-existing hard surfaces.

While holes may be drilled in hard surfaces and delineator means thereafter inserted, it is desirable that the delineators may be driven directly into the surface.

Described in co-pending application Ser. No. 101,439 filed Dec. 10, 1979 is a traffic delineator assembly in which a channel shaped anchor post is attached to a pilot plate which lies generally along a lower portion of a flexibly deformable delineator. The anchor post and pilot plate are driven below the surface of the roadway, and the flexible delineator extends upward therefrom.

The driving means herein described is particularly designed to facilitate the driving of the above-described traffic delineator assembly. The drive means has a lower surface for contact with the upper surface of the anchor post. A pair of legs depending from the lower surface of the drive means straddles the channel of the anchor post and locates between flanges of the anchor post and the pilot plate. The upper surface is generally flat with a depression therein so that it may either be struck manually with a hammer or linked by an adaptor to an impact type drive tool.

Figures 1, 2, 3, 4, 5, 6, 7, 8:
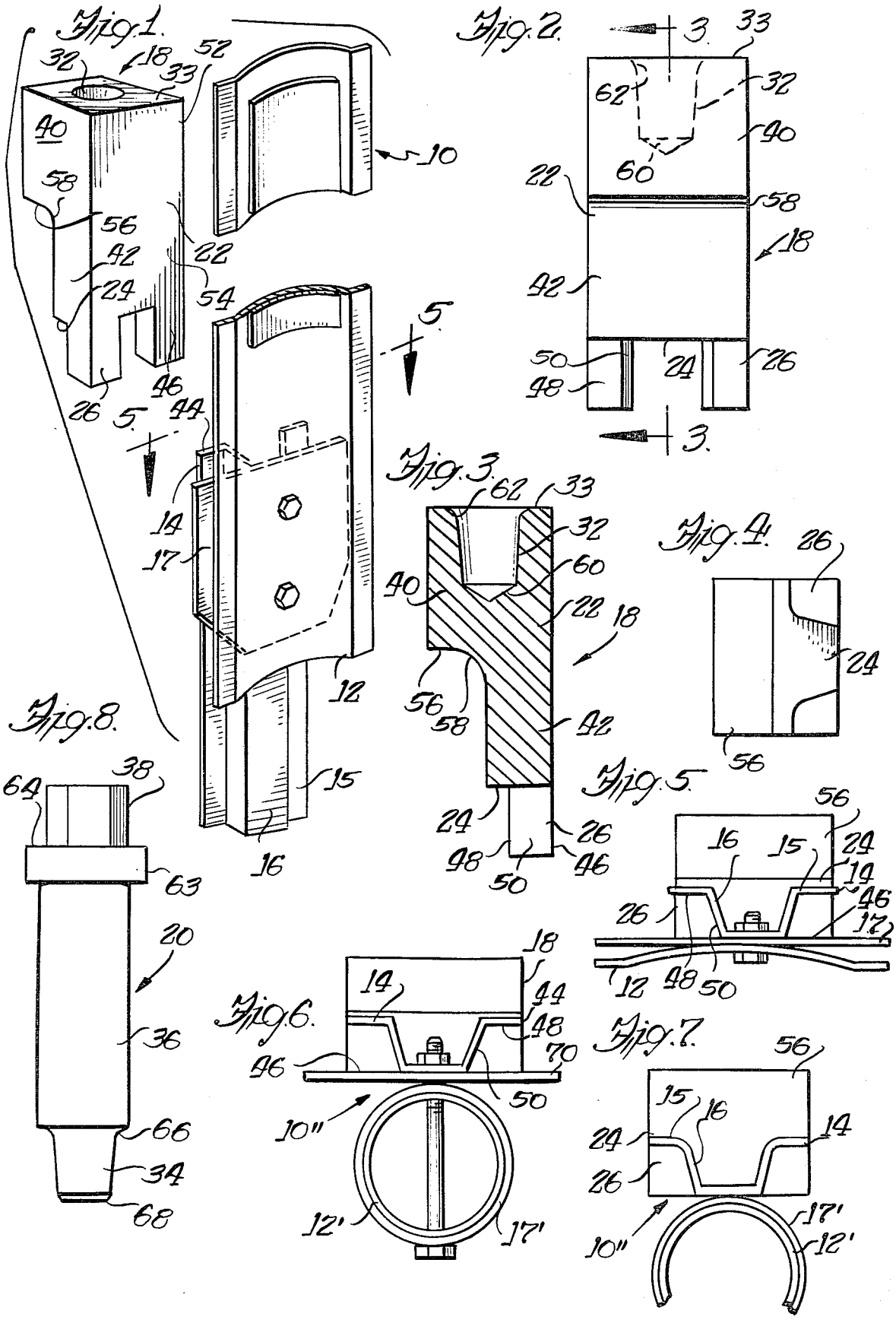
FIG. 1 is a perspective of the drive means and the traffic delineator assembly which it drives.
FIG. 2 is an elevation view of a drive means for a traffic delineator assembly.
FIG. 3 is a cross section view of the drive means shown in FIG. 2 taken along line 3—3 of FIG. 2.
FIG. 4 is a bottom plan view of the drive means shown in FIG. 2.
FIG. 5 is a bottom plan view of a drive means in driving engagement with a traffic delineator.
FIG. 6 is a bottom plan view, similar to that in FIG. 5, in which the drive means is positioned in driving engagement with an alternative embodiment of the delineator assembly.
FIG. 7 is a bottom plan view, similar to that of FIG. 5, wherein the drive means is positioned in driving engagement to a further alternative embodiment of the traffic delineator assembly.
FIG. 8 is a front elevation view of an adaptor to link the drive means with an impact type drive tool.

Described in the co-pending application referred to above is a traffic delineator assembly 10 in which a flexible delineator 12 is attached to a rigid channel-type anchor post 14 wherein coplanar lateral flanges 15 are interconnected by a generally U-shaped channel 16. A rigid pilot plate 17 bolted to the anchor post 14 pulls the flexible delineator 12 into the road or ground surface.

The anchor post 14 and pilot plate 17 are driven to where the flush top surfaces of each are below the road surface.

To drive such a delineator assembly 10 into a road surface, a drive means or cap 18 is employed to receive the blows of a sledge hammer or an impact type drive tool such as a jackhammer. When used with an impact tool an adaptor 20 links the drive tool with the drive cap 18.

The body 22 of the drive tool 18 has a lower surface 24 for driving contact with the anchor post 14. A pair of legs 26 depending from the lower surface 24 straddles the channel 16 and locates between the flanges 15 of the anchor post 14 and the pilot plate 17 to securely engage the tool 18 with the delineator assembly 10. A recess 32 in the upper surface 33 receives a cooperating member 34 of the adaptor 20 shown in FIG. 8. The adaptor 20, which links a jackhammer to the drive cap 18, is comprised of the lower linking member 34, a shank 36, and an upper male member 38 which cooperates with a female member of a jackhammer. When manually driven, i.e. with a sledgehammer, the generally flat upper surface 33 receives the hammer blows.

So that the invention may be fully understood, the drive means and adaptor will now be described in greater detail.

The drive cap 18 is comprised of a thick upper body portion 40 and a narrower lower body portion 42. The demensions of a cross section of the generally rectangular lower body portion are generally equal to or slightly larger than the width and thickness of the anchor post 14. Thus when the drive cap 18 is positioned on the anchor post 14, the lower surface 24 of the lower body portion 42 is seated generally along the entire upper surface 44 of the anchor post 14.

The legs 26 depend downward from the lower body 42 to straddle the channel 16. The legs 26 are contoured to provide a snug fit with the delineator assembly 10. A snug fit prevents slippage and resultant loss of efficiency and protects workers who would be endangered if the jackhammer should slip. When the drive cap 18 is engaged with the delineator assembly 10, the legs 26 fit along the outside of the channel 16 and between the flanges 15 of the anchor post 14 and the pilot plate 17. The legs 26 have generally parallel front 46 and back 48 surfaces to fit closely along the flanges 15 and the pilot plate 17. An inner surface 50 of each leg 26 angles from the front surface 46 to the back surface 48 to approximate the angled contours of the U-shaped channel 16.

While the lower body portion 42 is large enough to cover the upper edge 44 of the anchor post, it is sufficiently narrow so that it may easily be driven into the surface of the road to follow the anchor post 14 into the ground.

The upper body portion 40 has a generally rectangular cross section which is larger than that of the lower body portion. The front surface 52 of the upper body portion is continuous with the front surface 54 of the lower body portion 42 and the front surfaces 46 of the legs 26.

The rear of the upper portion 40 overhangs the lower portion 42 providing a shoulder 56. The transition 58 from the lower portion 45 to the upper portion 40 may be curved as illustrated in FIG. 3, or alternatively, may be a right angle junction. The shoulder 56 serves as a depth gauge for the drive cap 18. When the anchor post 14 is driven into the ground, the lower body portion 42 will follow the anchor post 14 into the ground. However, when the shoulder 56 abuts the road surface, driving will become significantly more difficult and penetration into the surface will effectively stop and signal the jackhammer operator that the delineator assembly 10 has been driven to a sufficient depth.

The upper body portion 42 is sufficiently large accommodate the recess 32 which extends downward from the upper surface 33 of the drive cap 18. The recess 32 cooperates with the adaptor 20 so that the impact of a jackhammer may be transmitted through the adaptor 20 to the drive cap 18.

The recess 32 may be a cylindrical in shape and may be formed by a drilling operation from the upper surface 33. The drilling operation may provide a lower conical portion 60 of the recess 32. The upper rim of the recess 32 is rounded to provide a convex shoulder 62 which contacts the adaptor 20.

The shank 36 of the adaptor 20 as illustrated in FIG. 8 may be cylindrical in shape but other configurations would be equally suitable. Depending upward from the shank 36 is the male member 38 which cooperates with a female member of the jackhammer. The male member 38 will generally have a hexagonal cross section as jackhammers are commonly provided with hexagonal female connections.

An annular ring 63 is located on the shank 36 just below the hexagonal male member 38. The upper surface 64 of the ring 63 receives the impact from the head of the jackhammer.

The linking member 34 depends coaxially with the shank 36 from the bottom thereof. The linking member 34 is generally cylindrical in shape to match the recess 32 of the drive cap. The radius of linking members 34 is smaller than the radius of the shank and a concave shoulder 66 at the upper end of the linking member 34 is contoured generally to match the convex shoulder 62 of the recess 32 to seat thereagainst, so that the impacting force may be transmitted therebetween. The length of the linking member 34 is generally the length of the recess 32 and the linking member 34 may have a frustoconical end 68 to seat against the bottom conical portion 60 of the recess 32 so that a portion of the impacting force may be transmitted therebetween.

While the recess 32 and linking members 34 have been described as generally cylindrical, preferably the diameters of each increases slightly from the bottom to the top to give the recess 32 and linking member 34 a frusticonical shape. This permits some of the force to be transmitted through the frusticonical walls and also facilitates the ingress and egress of the linking member 34.

In an alternative embodiment of the delineator assembly 10' as described in the above mentioned co-pending application, the anchor post 14 is attached to a cylindrical pilot plate 17' which contains therein the lower portion of a tubular delineator 12'. An anchor plate 70 for stabilization may be provided between the tubular pilot plate 17' and the anchor post 14. The legs 26 of the drive cap 18 locate between the anchor plate 70 and the anchor post 14 in a manner similar to engagement between the channel anchor post 14 and a flat pilot plate 17.

When a tubular pilot plate 17' is used, it may be used without an anchor plate 70, as illustrated in FIG. 7, so that the anchor post 14 is attached directly to the cylindrical pilot plate 17'. The driving member 18 as herein described similarly cooperates with the delineator assembly 10'' with the legs 26 straddling the channel 16 of the anchor post 14. However, the front surfaces 46 of the legs 26 do not fit tightly against the cylindrical pilot plate 17' which allows some lateral slippage. However, this slippage is small and accordingly, the drive cap 18 herein described is suitable for driving such a traffic delineator assembly 10'' into a hard surface.

The invention has been described in terms of certain preferred embodiments. Modifications obvious to one skilled in the art may be made without departing from the teachings of the present invention which are limited only by the following claims:

What is claimed is:

1. A drive means for driving into the ground or a road surface a traffic delineator assembly of the type which includes a channel shaped anchor post having a pair of outwardly extending flanges, the upper end of the channel being connected to a rigid plate member, said drive means comprising:

a body having a lower surface for surface contact with the upper end of the anchor post and an upper portion for receiving driving impact;

and a pair of legs depending from said lower surface to straddle the channel of the anchor post and locate between the flanges of the anchor post and said plate member.

2. A drive means according to claim 1 wherein said upper portion of said drive means includes a recess in a top surface to receive a locating member of an adaptor for linking said drive means with an impact type drive tool.

3. A drive means according to claim 1 wherein an upper portion of said body has a cross section greater than a cross section of a lower portion of said body and a shoulder is provided between said lower portion and said upper portion so that the driving of said anchor post is hindered when said shoulder contacts the surface into which said delineator assembly is driven.

4. A drive means according to claim 3 wherein said shoulder is spaced from said lower surface of said body about 2 inches so that said anchor post is driven about 2 inches below the surface.

5. A drive means according to claim 1 wherein a front surface of said drive means is flat.

6. A drive means according to claim 1 wherein an upper surface is generally flat to receive impact from a hammer means.

7. A combination of a drive means for driving into the ground or a road surface a traffic delineator assembly of the type which includes a channel shaped anchor post having a pair of outwardly extending flanges, the upper end of the channel being connected to a solid plate member, and an adaptor for transmitting the impacts of an impact type drive tool to said drive means wherein:

said drive means comprises;

a body having a lower surface for surface contact with the upper end of said anchor post, a recess in an upper surface of said body, and a pair of legs depending from said lower surface to straddle the channel of the anchor post and locate between the flanges of said anchor post and said plate member;

and wherein said adaptor comprises;

a shank;

a male member extending upward from said shank for insertion into a female member of the impact type drive tool;

and a linking member depending downward from said shank for insertion into said recess.

8. A combination according to claim 7 wherein said upper male member has a hexagonal cross section.

9. A combination according to claim 7 wherein an annular ring is provided around said shank below said male member for contact with a front surface of the impact type drive tool.

* * * * *